US006551767B1

(12) United States Patent
Niziurski-Mann et al.

(10) Patent No.: US 6,551,767 B1
(45) Date of Patent: Apr. 22, 2003

(54) PROCESS FOR PREPARING P-PHENYLENEDIAMINE COLOR DEVELOPERS IN A CONCENTRATED FREE-BASE FORM

(75) Inventors: Renee Ellen Niziurski-Mann, Kingsport, TN (US); Lucian Boldea, Jonesborough, TN (US); Phillip Montgomery Hudnall, Kingsport, TN (US); Michael Wayne Salyer, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

(21) Appl. No.: 09/976,783

(22) Filed: Oct. 13, 2001

(51) Int. Cl.[7] ..... G03C 7/407
(52) U.S. Cl. ..... 430/466
(58) Field of Search ..... 430/466

(56) References Cited

U.S. PATENT DOCUMENTS

| | | | |
|---|---|---|---|
| 4,876,174 A | 10/1989 | Ishikawa et al. | |
| 4,892,804 A | 1/1990 | Vincent et al. | |
| 5,273,865 A | 12/1993 | Loiacono et al. | |
| 5,354,646 A | 10/1994 | Kobayashi et al. | |
| 5,646,327 A | 7/1997 | Burns et al. | |
| 5,660,974 A | 8/1997 | Marrese et al. | |
| 5,702,873 A | 12/1997 | Twist | |
| 5,709,982 A | 1/1998 | Marrese et al. | |
| 5,723,268 A | 3/1998 | Fyson | |
| 6,017,687 A | 1/2000 | Darmon et al. | |
| 6,020,113 A | 2/2000 | Abe | |
| 6,077,651 A | 6/2000 | Darmon et al. | |
| 6,228,567 B1 | 5/2001 | Darmon et al. | |
| 6,428,946 B2 * | 8/2002 | Buongiorne et al. | 430/450 |

FOREIGN PATENT DOCUMENTS

| | | |
|---|---|---|
| EP | 0 204 372 A1 | 12/1986 |
| EP | 0 434 097 A1 | 6/1991 |
| EP | 0 530 921 A1 | 3/1993 |
| EP | 0 793 141 A2 | 9/1997 |

OTHER PUBLICATIONS

R. L. Bent et al., "Chemical Constitution, Electrochemical, Photographic and Allergenic Properties of p–Amino–N–di-alkylanilines," Journal of the American Chemical Society, 1951, pp. 3100–3125, vol. 73, United States.

Klaus J. Erdweg, "Molecular and Short–Path Distillation," Chemistry and Industry, May 2, 1983, pp. 342–345, United States.

* cited by examiner

*Primary Examiner*—Hoa Van Le
(74) *Attorney, Agent, or Firm*—Jonathan D. Wood; Bernard J. Graves, Jr.

(57) ABSTRACT

An improved method for making a p-phenylenediamine color developer concentrate in a free-base form wherein the sulfate or chloride salt of the color developer is contacted with an alkali metal hydroxide includes the steps of forming a liquid free-base layer and a water layer, separating the liquid free-base layer from the water layer; and mixing the liquid free-base with a water soluble hydroxy organic solvent, wherein the p-phenylenediamine color developer concentrate has at least 0.06 mol/l of a color developing agent in the free base form.

17 Claims, No Drawings

PROCESS FOR PREPARING P-PHENYLENEDIAMINE COLOR DEVELOPERS IN A CONCENTRATED FREE-BASE FORM

BACKGROUND OF THE INVENTION

1. Field of the Invention

The present invention relates to a method for preparing solutions of p-phenylenediamine color developers in a concentrated free-base form. More particularly the present invention is an improvement in preparing solutions of p-phenylenediamine color developers in a concentrated free-base from a sulfate or chloride acid salt precursor, in a photographically inactive and compatible, water miscible or water soluble, organic solvent.

2. Background of the Invention

The basic processes for obtaining useful color images from exposed color photographic silver halide materials include several steps of photochemical processing such as color development, silver bleaching, silver halide fixing and water washing or dye image stabilizing using appropriate photochemical compositions. Photographic color developing compositions are used to process color photographic materials such as color photographic films and papers to provide the desired dye images early in the photo processing method. Such compositions generally contain color developing agents which act as reducing agents to react with suitable color forming couplers to form the desired dyes.

Color development of an image exposed photographic silver halide element is carried out by contacting the exposed color paper with a color developing composition prepared from the color developer concentrate of the present invention and under suitable time, temperature conditions, and in suitable processing equipment, to produce the desired developed image such as a color print. Additional processing steps can then be carried out using conventional procedures, including but not limited to, one or more development stop, bleaching, fixing, bleach/fixing, washing or rinsing, stabilizing and drying steps, in any particular desired order as would be known in the art.

Suitable color developing agents that are known in the art include aromatic amino color developing agents such as p-phenylenediamines, and particularly the N,N-dialkyl-p-phenylenediamines in which the alkyl groups or the aromatic nucleus can be substituted or unsubstituted. The p-phenylenediamine color developers most commonly present in photofinishing compositions include: N,N-diethyl-2-methyl-p-phenylenediamine monohydrochloride (CD-2); N-ethyl-N-2-(methanesulfonylaminoethyl)-2-methyl-p-phenylenediamine sesquisulfate monohydrate (CD-3); and N-ethyl-N-(2-hydroxyethyl)-2-methyl-p-phenylenediamine sulfate (CD-4), listed here in the commonly used acid salt form.

The photographic finishing industry is comprised of three primary segments: the manufacture of photographic chemicals to supply photochemical formulators, the formulation of these chemicals into useful compositions for photochemical processing, and the processing of sensitized photographic color elements. Formulated photographic processing (photofinishing) solutions provided to the processors are complex, multi-part, multi-component mixtures, the specific compositions of which vary significantly according to the intended use and the formulator.

Color developing compositions are commonly supplied in multiple parts or solutions because of the requirement to separate components which are reactive or unstable over extended periods of time. One part normally includes an acid salt of a p-phenylenediamine color developer, typically in the form of a stabilized aqueous solution. These solutions are acidic since the color developer is formulated in this part as the acid salt. Another part typically contains a base or combination of bases which, upon mixing of the parts, serves to neutralize the acid associated with the part containing the color developer and to establish the desired alkalinity of the mixed color developing composition. These solutions are typically mixed immediately before use. Upon combination of all parts and water, a homogeneous color developing composition can usually be obtained for the working strength solution in the processing machine.

The free-base forms of these color developers are presently industrially processed in solutions as prepared from the acid salt form of the p-phenylenediamine. The free base form of the color developer is prepared by mixing an aqueous solution of the color developer salt with an alkali metal hydroxide, typically sodium hydroxide. For example, U.S. Pat. No. 6,017,687 issued to Darmon et al. on Jan. 25, 2000 and U.S. Pat. No. 6,077,651 issued to Darmon et al. on Jun. 20, 2000 disclose a homogeneous, single-part, color developing concentrate that is prepared using a critical sequence of steps. In the first step, an aqueous solution of the color developing agent containing a preservative is prepared typically from the sulfate salt and an alkali metal base to provide a stoichiometric proportion of alkali metal ions to render the color developer in a free base form in a liquid phase. The addition of an alcohol or glycol solvent forces precipitation of the sulfate salts, which are subsequently removed by filtration. It has been found that due to the particle size of the precipitate, filtration is inefficient, time consuming and generally results in some residual sulfate ions in solution, which these patents teach is detrimental to the composition stability of a photofinishing solution.

The use of such combined photofinishing solutions results in simplicity of operation with a reduction in the potential of mixing errors and poor photo processing results. The major incompatibility of the traditional parts of photofinishing solutions is that between the acidic aqueous part, containing the acid salt of the p-phenylenediamine color developer, and the alkaline part, containing the base or combination of bases. Since the active color developer in the final, mixed photofinishing composition is the free base form of the color developer, full consolidation of parts to produce a single-part formulation requires a source of the p-phenylenediamine color developer in free base form as the necessary ingredient. As used herein, the term "free-base" refers to phenylenediamine compounds devoid, or essentially devoid, of acid addition salts of phenylenediamines.

The industry has investigated the use of both concentrates and solid mixtures (including powders and tablets). In most cases, concentrates are convenient to use but may have high packaging costs compared to powders. Powders permit high concentration, but not every photochemical composition can be dried into a stable powder. Powders present problems with dust, separate packaging needs and more troublesome metering or mixing procedures. In addition not every dry formulation is readily dissolved in water.

Accordingly, there is a need for a method for preparing a single-part color developing composition that is homogeneous, concentrated and stable. Such compositions would reduce the cost of shipping and storage of diluted solutions, avoid the need for mixing multiple parts or agitation of multi-phase compositions, and offer the user a more attractive product. The present invention is directed to meeting this long felt need.

SUMMARY OF THE INVENTION

The present invention provides a method for preparing a homogeneous, aqueous single-part color developing concentrate having at least 0.06 mol/l of color developing agent in the free-base form, an antioxidant and a water soluble hydroxy-substituted organic solvent. The method includes a critical sequence of steps after contacting a sulfate or chloride salt of the color developer with an alkali metal hydroxide comprising: (a) forming liquid free-base and water layers in a suitable container; (b) separating the liquid free-base layer from the water layer; and (c) mixing the liquid free-base with a water miscible or water soluble hydroxy organic solvent. The method may optionally include the step(s) of: (d) heating the liquid free-base and water layers, and (e) water washing the liquid free-base layer after the separating step and separating the wash water from the liquid free-base layer. Preferably, the resulting concentrate is essentially sulfate ion free, that is, the concentrate has less than 0.005 mol/l of sulfate ion.

The method for preparing a color developing concentrate offers numerous advantages over presently used methods for preparing a single part photochemical concentrate currently known or used. Advantageously, the concentrate prepared has minimal water, resulting in considerable savings in manufacturing, shipping and storage costs. In addition, the concentrate prepared by the method described herein is free of precipitates, slurries or multiple solvent phases.

Another advantage of the present method is that the sulfate ions are removed early in the formulation of the concentrate by dissolving the precipitate in the aqueous phase, which is subsequently separated from the p-phenylenediamine-type color developers in the oil phase. This was found to substantially improve the recovery of the p-phenylenediamine-type color developers.

DETAILED DESCRIPTION OF THE INVENTION

Describing the method for preparing a color developer concentrate and preferably a p-phenylenediamine-type color developer in greater detail, as is known in the art, an aqueous solution of a suitable color-developing agent is prepared by dissolving a predetermined amount of p-phenylenediamine color developer in its sulfate or halide salt form in a predetermined amount of water. Generally, the developer to water ratio, in mL to grams, is from about 0.5:4 and preferably from about 1:3.

The dissolved color developer is mixed with a predetermined amount of an alkali metal base, to provide a suitable number of alkali metal ions in an at least stoichiometric proportion to the sulfate ions. Suitable alkali metal bases include lithium hydroxide, sodium hydroxide, potassium hydroxide and mixtures thereof. Other components of the solution can include an antioxidant for the color-developing agent, and a photographically inactive water-miscible or water-soluble hydroxy-containing organic solvent. The amount of alkali metal base added is sufficient to react with the p-phenylenediamine color developer acid salt to form a free base of at least about 90 weight % of the p-phenylenediamine color developer in the acid salt and preferably at least about 95 weight % and more preferably greater than about 99 weight % of the p-phenylenediamine color developer in the acid salt. It is critical to the present invention that the amount of alkali metal base mixed with the p-phenylenediamine color developer acid salt be sufficient to form, in a suitable container such as a decanter vessel, a liquid free-base layer and a water layer. Optionally, it may be necessary to heat the alkali metal base and p-phenylenediamine color developer acid salt to dissolve any precipitate and to form a separate free-base layer and a separate water layer.

The aromatic primary amine color developing agents useful in the present invention include various known p-phenylenediamine derivatives. Especially preferred are the N,N-dialkyl-p-phenylenediamine derivatives wherein the alkyl groups or the alkenyl groups may independently include straight, branched or cyclic moieties. For example, their substituents may include halogen atoms (such as F, Cl and Br), aryl groups (such as phenyl and p-chlorophenyl groups), alkoxy groups (such as methoxy, ethoxy and methoxyethoxy groups), aryloxy groups (such as phenoxy group), sulfonyl groups (such as methanesulfonyl and p-toluenesulfonyl groups), sulfonamido groups (such as methanesulfonamido and benzenesulfonamido groups), sulfamoyl groups (such as diethylsulfamoyl and unsubstituted sulfamoyl groups), carbamoyl groups (such as unsubstituted carbamoyl and diethylcarbamoyl groups), amido groups (such as acetamido and benzamido groups), ureido groups (such as methylureido and phenylureido groups), alkoxycarbonylamino groups (such as methoxycarbonylamino group), aryloxycarbonylamino groups (such as phenoxycarbonylamino group), alkoxycarbonyl groups (such as methoxycarbonyl group), aryloxycarbonyl groups (such as phenoxycarbonyl group), cyano group, hydroxy group, carboxy group, sulfo group, nitro group, amino groups (such as unsubstituted amino group and diethylamino group), alkylthio groups (such as methylthio group), arylthio groups (such as phenylthio group) and heterocyclic groups (such as morpholyl and pyridyl groups).

Preferred color developing agents include, but are not limited to, N,N-diethyl-2-methyl-p-phenylenediamine monohydrochloride (CD-2); N-ethyl-N-2-(methanesulfonylaminoethyl)-2-methyl-p-phenylenediamine sesquisulfate monohydrate (CD-3); and N-ethyl-N-(2-hydroxyethyl)-2-methyl-p-phenylenediamine sulfate (CD-4), other salt forms (e.g. phosphates and tosylates) and the free base forms of any of the listed compounds, and others readily apparent to one skilled in the art.

In order to protect the color developing agents from oxidation, one or more preservatives and/or antioxidants are generally included in the color developing concentrates. Either inorganic or organic antioxidants can be used. Many classes of useful antioxidants are known, including but not limited to, sulfites, such as sodium sulfite, potassium sulfite, sodium bisulfite, sodium metabisulfite and potassium metabisulfite, hydroxylamine and derivatives thereof, hydrazines, hydrazides, phenols, amino acids, ascorbic acid and derivatives thereof, hydroxamic acids, aminoketones, mono- and polysaccharides, mono- and polyamines, quaternary ammonium salts, nitroxy radicals, alcohols, and oximes. Especially useful antioxidants are hydroxylamine derivatives which include, but are not limited to N,N-bis(2,3-dihydroxypropyl)hydroxylamine, N,N-bis(2-methyl-2,3-dihydroxypropyl) hydroxylamine and N,N-bis(1-hydroxymethyl-2-hydroxy-3-phenylpropyl) hydroxylamine. The specific preservative or preservative combination used will depend upon the formulation and application.

The preservative or antioxidants may be added to the mixture of the liquid free base and water at any time, such as prior to phase separation, during phase separation, after phase separation or after the next step of the present method, i.e., separating the liquid free-base layer from the water layer.

Preferably, the liquid free base and water are mixed in an appropriate vessel that is adapted for separating the liquid free-base layer from the water layer by such methods as decanting the water layer or by siphoning the water layer from the top of the vessel. Such decanting vessels are well known to those skilled in the art of liquid/liquid phase separations.

Optionally, the free-base and water mixture may be heated to a temperature of less than about 90° C., and preferably to a temperature of about 60° C. to 85° C., to effect layer separation.

To improve the removal of any dissolved sulfate ions from the liquid free base, the liquid free base color developer may be contacted with one or more water wash cycles or steps wherein the free base is preferably mixed with deionized water then allowed to phase separate for removing the water phase. Desirably, the water is added in a manner to permit intimate mixing of the free base and water for absorption of any remaining sulfate ions from the free base material. Such mixing may be achieved by using agitating devices, such as mixing blades, agitators and the like. Alternatively, the water may be sparged into the liquid free base so that intimate mixing takes place.

The method of the present invention further includes mixing the liquid free-base with a photographically inactive, water-miscible or water-soluble, organic solvent that is capable of dissolving color developing agents in their free base forms. Such organic solvents can be used singly or in combination. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. As used herein, "photographically inactive" means that the organic solvents provide no substantial positive or negative effect upon the color developing function of the concentrate.

Photographically inactive water-miscible or water-soluble hydroxy-containing organic solvents include, but are not limited to, alkanols containing 2 to 8 carbon atoms such as ethyl alcohol, 1-propanol, 2-propanol, 1-butanol, 2-butanol, 2-methyl-1-propanol, 1-pentanol, 2-pentanol, 3-methyl-1-butanol, and 3-methyl-2-butanol; glycols containing 2 to 8 carbon atoms such as ethylene glycol, propylene glycol, 1,4-butanediol, 1,3-butanediol, 2-methyl-1,3-propanediol, 1,4-cyclohexanedimethanol, diethylene glycol, and triethylene glycol; polyethylene glycols such as PEG-200, PEG-300, PEG-400, and PEG-600; glycol ethers containing 3 to 8 carbon atoms such as 2-methoxyethanol, 2-ethoxyethanol, 2-propoxyethanol, 2-isopropoxyethanol, 2-butoxyethanol, 1-methoxy-2-propanol, 1-ethoxy-2-propanol, 3-methoxy-1-butanol, dioxane, diethylene glycol monomethyl ether, diethylene glycol monoethyl ether, diethylene glycol mono-n-propyl ether, diethylene glycol mono-i-propyl ether, diethylene glycol monobutyl ether, and triethylene glycol monomethyl ether; polyols such as glycerol; and polyol ethers containing 3 to 8 carbon atoms such as 3-methoxy-1,2-propanediol and 3-ethoxy-1,2-propanediol. Preferably, the solvent used is PEG-200, diethylene glycol, ethylene glycol, or propylene glycol. Such organic solvents can be used singularly or in combination.

Optionally, the method for preparing p-phenylenediamine color developer concentrates may include filtering the free base concentrate to remove any remaining undissolved alkali metal salt and to provide a substantially clear solution.

The color developer concentrate may further contain other materials generally present in such color developing compositions. For example, the developer concentrate may include water, buffering agents, alkali metal halides, metal sequestering compositions, such as polycarboxylic or aminopolycarboxylic acids or polyphosphonates with or without lithium, magnesium or other small cations, auxiliary co-developing agents, such as phenidone type compounds particularly for black and white developing compositions, antifoggants, alkanolamines, development accelerators, optical brighteners, such as triazinylstilbene compounds, wetting agents, fragrances, stain reducing agents, surfactants, defoaming agents, and water-soluble or water-dispersible color couplers, as would be readily understood by one skilled in the art. The amounts of such additives are also well known in the art.

The color developer concentrates of this invention have utility to provide color development in an exposed photographic silver halide color paper comprising a support and one or more silver halide emulsion layers containing an image distribution of developable silver halide emulsion grains. In particular, the invention can be used to process color photographic papers of all types of emulsions. The layers of the color papers can have any useful binder material or vehicle as it known in the art, including various gelatins and other colloidal materials.

The present invention is illustrated in greater detail by the specific examples presented below. It is to be understood that these examples are illustrative embodiments and are not intended to be limiting of the invention, but rather are to be construed broadly within the scope and content of the appended claims. Unless otherwise indicated, all percentages are by weight.

EXAMPLE 1

An aqueous color developer was prepared by mixing together 13.6 grams (g) of N-ethyl-N-2-(methanesulfonylaminoethyl)-2-methyl-p-phenylenediamine sesquisulfate monohydrate (CD-3), 65 milliliters (mL) of deionized water and 0.2 g of sodium sulfite, as a preservative to suppress color formation, in a flask and under a nitrogen blanket. To this mixture 8 g of 50% weight % of aqueous sodium hydroxide was added to form a precipitate. This mixture was heated to a temperature of 60–62° C. to dissolve the solid precipitate and to form a free base color developer layer and a water layer.

Using a dip tube under vacuum, substantially all of the upper water layer was removed from flask. The free base color developer was water washed using 65 mL of deionized water and 0.2 g of sodium sulfite was added. This mixture was stirred and heated to a temperature of 70–75° C. After the mixture was stirred for several minutes, agitation was stopped and the mixture was allowed to separate, forming a free base color developer layer and a water layer. Using a dip tube under vacuum, substantially all of the upper water layer was again removed from flask.

To the washed liquid free base color developer 100 g of diethylene glycol was added and the mixture stirred until homogeneous. The p-phenylenediamine color developer free base concentrate solution was allowed to cool to room temperature and then filtered to remove any remaining solids. The filter was rinsed with 40 g of 100 weight % diethylene glycol.

The filtered p-phenylenediamine color developer was essentially free of sulfate salts and the yield was 66.5 weight % as determined by HPLC.

EXAMPLES 2–9

In Examples 2–9, the procedure described in Example 1 above was followed except the amounts were varied and the results are as indicted in Table I below.

TABLE I

| | Reaction mixture | | | | | | Water Wash | | | Solvent | CD-3 Free Base | |
|---|---|---|---|---|---|---|---|---|---|---|---|---|
| Example Number | CD-3 (g) | Deionized Water (ml) | 50% aq. NaOH (g) | CD-3 % of total reaction mixture | Temp #1 (° C.) | Aqueous phase on bottom? | Water (ml) | Temp #2 (° C.) | Aqueous phase on bottom? | (total) DEG[a] (g) | % Yield[b] | % CD-3 freebase in final solution[b] |
| 2 | 13.6 | 50 | 8 | 18.9 | 70–75 | N | 50 | 70–75 | N | 140 | 61.7 | 3.4 |
| 3 | 13.6 | 50 | 8 | 18.9 | 60–65 | N | 50 | 70–75 | N | 140 | 55.4 | 3.1 |
| 4 | 13.6 | 50 | 6 | 19.5 | 50–55 | N | 30 | 50–55 | N | 140 | 23.4 | 1.3 |
| 5 | 13.6 | 35 | 9 | 23.5 | 62–65 | N | 30 | 60–65 | N | 140 | 33.9 | 1.9 |
| 6 | 13.6 | 35 | 6 | 24.8 | 50–55 | N | 35 | 50–55 | N | 140 | 21.4 | 1.2 |
| 7 | 27.2 | 50 | 15 | 29.4 | 60–65 | Y | 25 | 60–65 | N | 140 | 102.2 | 10.9 |
| 8 | 13.6 | 65 | 8 | 14.1 | 60–65 | N | 65 | 60–65 | N | 140 | 30.9 | 1.8 |
| 9 | 13.6 | 35 | 6 | 21.1 | 60–65 | Y | 35 | 60–65 | N | 140 | 67.8 | 3.8 |

[a]DEG—Diethylene glycol
[b]Determined by HPLC weight percent method

EXAMPLE 10

An aqueous color developer was prepared by mixing together 40.8 g of CD-3, 45 mL of deionized water and 15 g of N,N-diethylhydroxylamine as a preservative in a flask and under a nitrogen blanket. To this mixture, 22.5 g of 50% aqueous sodium hydroxide was added to obtain a pH of about 8. A precipitate was formed. This mixture was heated to a temperature of 60–65° C. to dissolve the solid precipitate and to form a free base color developer layer and a water layer.

Substantially all of the bottom water layer was decanted from the flask. One hundred and fifty (150) g of diethylene glycol was added and the mixture stirred until homogeneous. The p-phenylenediamine color developer free base concentrate solution was allowed to cool to room temperature and then filtered to remove any remaining solids. The filter was rinsed with 60 g of diethylene glycol.

The filtered p-phenylenediamine color developer was essentially free of sulfate salts. The yield was 99.4% as determined by HPLC.

EXAMPLES 11–23

In Examples 11–23, the procedure described in Example 10 above was followed except the amounts were varied and the results are as indicted in Table II below.

TABLE II

| | Reaction mixture | | | | | | CD-3 Free Base | | |
|---|---|---|---|---|---|---|---|---|---|
| Ex. No. | CD-3 (g) | Water (ml) | 50% aq. NaOH (g) | CD-3 % of total reaction mixture | Temp #1 (° C.) | Solvent (total) DEG[a] (g) | % Yield[b] | Sulfur (ppm) | % CD-3 freebase in final solution[b] |
| 11 | 27.2 | 50 | 15 | 26.6 | 60–65 | 140 | 85.1 | 210 | 8.6 |
| 12 | 40.8 | 60 | 22.5 | 29.9 | 60–65 | 210 | 93.6 | 196 | 9.6 |
| 13 | 40.8 | 45 | 24 | 32.7 | 60–65 | 210 | 93.7 | 120 | 9.4 |
| 14 | 40.8 | 45 | 19.5 | 33.9 | 60–65 | 210 | 92.3 | 1680 | 9.5 |
| 15 | 40.8 | 35 | 22.5 | 36.0 | 60–65 | 210 | 102.5 | 120 | 10.3 |
| 16 | 40.8 | 35 | 22.5 | 35.9 | 60–65 | 210 | 91.5 | 390 | 9.3 |
| 17 | 40.8 | 45 | 22.5 | 33.1 | 60–65 | 210 | 106.2 | 94 | 10.9 |
| 18 | 40.8 | 45 | 22.5 | 33.0 | 60–65 | 210 | 92.0 | 90 | 9.3 |
| 19 | 40.8 | 145 | 36.0[c] | 17.2 | 80–85 | 210 | 78.4 | 80 | 7.6 |
| 20 | 40.8 | 45 | 22.5 | 29.5 | 60–65 | 210 | 87.2 | 23 | 8.1 |
| 21 | 40.8 | 35 | 22.5 | 31.8 | 60–65 | 210 | 97.6 | 1 | 9.1 |
| 22 | 40.8 | 35 | 22.5 | 36.0 | 80–85 | 210 | 95.9 | 10 | 9.6 |
| 23 | 40.8 | 45 | 22.5 | 33.1 | 80–85 | 210 | 94.8 | 3 | 9.4 |

[a]DEG—Diethylene glycol
[b]Determined by HPLC weight percent method
[c]Used 45% aqueous KOH. Additional water was required to dissolve all of the precipitates.

EXAMPLE 24

An aqueous color developer was prepared by mixing together 28 g of N-ethyl-N-(2-ethyl)-2-methyl-p-phenylenediamine sulfate (CD-4), 56 mL of deionized water, and 10 g of diethylhydroxyl amine in a flask and under a nitrogen blanket. To this mixture 13.75 g of 50 weight % aqueous sodium hydroxide was added to obtain a pH of about 8. This mixture was heated to about 60–65° C. Afterwards, the solution was allowed to settle and form a free base color developer layer and a lower water layer.

The water layer was decanted and 100 g of poly(ethylene glycol) having an average molecular weight of 200 (PEG 200) was added to the color developer free base concentrate solution. The solution was allowed to cool to room temperature and then filtered to remove any remaining solids. The filter was rinsed with 40 g of PEG 200.

The filtered p-phenylenediamine color developer was essentially free of sulfate salts. The yield was 85.0% as determined by NMR.

EXAMPLE 25

In Example 25, the procedure described in Example 24 above was followed except 1.2 grams of $Na_2SO_3$, and 20 grams of $Et_2NOH$ as well as having the amounts varied as specified. The results are as indicted in Table III below.

TABLE III

| Reaction mixture | | | | | CD-4 Free Base Data | | |
|---|---|---|---|---|---|---|---|
| CD-4 salt (g) | Water (ml) | 50% aq. NaOH (g) | CD-4 salt as % of total reaction mixture | Temp #1 (° C.) | % Yield[a] | Sulfur (ppm) | % CD-4 freebase in final solution[a] |
| 56 | 112 | 27.5 | 25.84 | 65 | 94.6 | 560 | 10.7 |

[a]Determined by $^1$H NMR weight percent method

EXAMPLE 26

An aqueous color developer mixture was prepared by mixing together 80 ml of deionized water, 20 g of N,N-diethylhydroxyl-amine, and 27.2 g N,N-diethyl-2-methyl-p-phenylenediamine monohydrochloride (CD-2) in a stirred round bottom flask and under a nitrogen blanket. The flask had a bottom outlet valve. To this mixture, 11.2 g of 50 weight % aqueous solution of sodium hydroxide was added to the flask. A slight exotherm occurred that warmed the solution to approximately 35° C. The solution was stirred for an additional five minutes before agitation was stopped and the two liquid phases were allowed to separate. The lower aqueous layer was decanted. Afterwards, 200 g of PEG 200 was added to the liquid CD-2 free base remaining in the flask. The solution was allowed to cool to room temperature then clarified through a filter to remove any remaining solids. The filter was rinsed with 80 g of PEG 200. The filtered solution was essentially free of chloride salts. The yield was 93.4% as determined by a weight percent NMR method.

The above example illustrates that chloride ions can be removed from the free base of a color developer with a good yield of free base material.

EXAMPLES 27 and 28

In Examples 27 and 28, the procedure described in Example 26 above was followed except the amounts were varied and the results are as indicted in Table IV below.

TABLE IV

| | Reaction mixture | | | | | | | CD-2 Free Base Data | | |
|---|---|---|---|---|---|---|---|---|---|---|
| Example Number | CD-2 salt (g) | 50% aq. NaOH (g) | $Na_2SO_3$ (g) | $Et_2NOH$ (g) | Deionized $H_2O$ (ml) | Temp #1 (° C.) | CD-2 salt as % of total reaction mixture | % Yield[a] | % CD-2 freebase in final solution[a] | Chloride (ppm) |
| 27 | 27.2 | 11.2 | 1.2 | 20[b] | 80 | 35 | 19.48 | 105.0 | 7.6 | 110 |
| 28 | 27.2 | 11.2 | 0 | 20[c] | 80 | 35 | 19.65 | 102.7 | 7.6 | 13 |

[a]Determined by $^1$H NMR weight percent method for CD-2 freebase
[b]Added after separation of layers was complete.
[c]Added prior to layer separation.

COMPARATIVE EXAMPLES 1 and 2

Following the teachings of U.S. Pat. No. 6,077,651, 300 grams of diethylene glycol, 32.4 grams of diethylhydroxyl amine, 40.8 grams of CD-3, and 36 grams of deionized water was charged to a 500 ml drop bottom flask under nitrogen at room temperature. To this mixture, 24 grams of 50% aqueous sodium hydroxide was added to the flask. The pH of the mixture was between 11.5–12. The reaction flask contents were allowed to cool to 28° C. The contents were filtered for 15–20 minutes through a buchner funnel. The filter was washed with 120 g of diethylene glycol (~10 minutes). Weight of filtrate was 436.2 grams. The LC assay was 4.7 weight % of CD-3 freebase (20.5g), and a yield of 81.8%. The sulfur in the CD-3 freebase was 166 ppm.

A second sample was prepared as described above. The weight of filtrate was 450.8 grams. The LC assay was 3.3 weight % of CD-3 freebase (14.9g) and a yield of 59.4%. The sulfur in the CD-3 freebase was 128 ppm.

Having described the invention in detail, those skilled in the art will appreciate that modifications may be made to the various aspects of the invention without departing from the scope and spirit of the invention disclosed and described herein. It is, therefore, not intended that the scope of the invention be limited to the specific embodiments illustrated and described but rather it is intended that the scope of the present invention be determined by the appended claims and their equivalents. Moreover, all patents, patent applications, publications, and literature references presented herein are incorporated by reference in their entirety for any disclosure pertinent to the practice of this invention.

We claim:

1. In a method for making a free-base form of a p-phenylenediamine color developer concentrate by contacting a sulfate or chloride salt of said color developer with an alkali metal hydroxide wherein the improvement comprises:

a. forming liquid free-base and water layers;

b. separating said liquid free-base layer from said water layer; and c. mixing said liquid free-base with a water soluble hydroxy organic solvent, wherein said p-phenylenediamine color developer concentrate has at least 0.06 mol/l of a color developing agent in the free base form.

2. The method of claim 1 wherein said p-phenylenediamine color developer is selected from the group consisting of N,N-dialkyl-p-phenylenediamine derivatives wherein said alkyl moiety and said alkenyl moiety may independently be selected from the group consisting of F, Cl, Br, phenyl, p-chlorophenyl, methoxy, ethoxy, methoxyethoxy, phenoxy, sulfonyl, methanesulfonyl, p-toluenesulfonyl, methanesulfonamido, benzenesulfonamido, diethylsulfamoyl, unsubstituted sulfamoyl moieties, unsubstituted carbamoyl moieties, diethylcarbamoyl moieties, acetamido moieties, benzamido moieties, methylureido, phenylureido moieties, methoxycarbonylamino moieties, aryloxycarbonylamino moieties, methoxycarbonyl moieties, phenoxycarbonyl moieties, cyano moieties, hydroxy moieties, carboxy moieties, sulfo moieties, nitro moieties, amino moieties, diethylamino moieties, methylthio moieties, phenylthio moieties, morpholyl moieties, and pyridyl moieties.

3. The method of claim 2 wherein said p-phenylenediamine color developer is selected from the group consisting of N,N-diethyl-2-methyl-p-phenylenediamine monohydrochloride (CD-2); N-ethyl-N-2-(methanesulfonylaminoethyl)-2-methyl-p-phenylenediamine sesquisulfate monohydrate (CD-3); and N-ethyl-N-(2-hydroxyethyl)-2-methyl-p-phenylenediamine sulfate (CD-4).

4. The method of claim 2 wherein said alkali metal hydroxide is selected from the group consisting of lithium hydroxide, sodium hydroxide, potassium hydroxide and mixtures thereof.

5. The method of claim 3 wherein said free-base layer is above said water layer and said layers are separated by decanting the water layer.

6. The method of claim 1 wherein said water soluble hydroxy organic solvent is selected from the group consisting of ethyl alcohol, 1-propanol, 2-propanol, 1-butanol, 2-butanol, 2-methyl-1-propanol, 1-pentanol, 2-pentanol, 3-methyl-1-butanol, and 3-methyl-2-butanol, ethylene glycol, propylene glycol, 1,4-butanediol, 1,3-butanediol, 2-methyl-1,3-propanediol, 1,4-cyclohexanedimethanol, diethylene glycol, and triethylene glycol, 2-methoxyethanol, 2-ethoxyethanol, 2-propoxyethanol, 2-isopropoxyethanol, 2-butoxyethanol, 1-methoxy-2-propanol, 1-ethoxy-2-propanol, 3-methoxy-1-butanol, dioxane, diethylene glycol monomethyl ether, diethylene glycol monoethyl ether, diethylene glycol mono-n-propyl ether, diethylene glycol mono-i-propyl ether, diethylene glycol monobutyl ether, and triethylene glycol monomethyl ether; glycerol; 3-methoxy-1,2-propanediol, 3-ethoxy-1,2-propanediol and mixtures thereof.

7. The method of claim 1 further comprising adding to said free-base p-phenylenediamine color developer a preservative selected from the group consisting of sodium sulfite, potassium sulfite, sodium bisulfite, sodium metabisulfite, potassium metabisulfite, hydroxylamine, hydrazines, hydrazides, phenols, amino acids, ascorbic acid, hydroxamic acids, aminoketones, mono- and polysaccharides, mono- and polyamines, quaternary ammonium salts, nitroxy radicals, alcohols, N,N-bis(2,3-dihydroxypropyl)hydroxylamine, N,N-bis(2-methyl-2,3-dihydroxypropyl) hydroxylamine, N,N-bis(1-hydroxymethyl-2-hydroxy-3-phenylpropyl) hydroxylamine and mixtures thereof.

8. The method of claim 1 further comprising heating said liquid free-base and water layers.

9. The method of claim 1 further comprising water washing said liquid free-base layer after said separating step.

10. The method of claim 8 wherein said water is separated from said liquid free-base layer.

11. In a method for making a free-base form of a p-phenylenediamine color developer concentrate by contacting a sulfate or chloride salt of said color developer with an alkali metal hydroxide wherein the improvement comprises:

a. forming a free-base and water mixture;

b. heating said free-base and water mixture to effect formation of a free-base layer and a water layer;

c. separating said liquid free-base layer from said water layer; and d. mixing said liquid free-base with a water soluble hydroxy organic solvent, wherein said p-phenylenediamine color developer concentrate has at least 0.06 mol/l of a color developing agent in the free base form.

12. The method of claim 11 wherein said p-phenylenediamine color developer is selected from the group consisting of CD-2, CD-3 and CD-4.

13. The method of claim 11 wherein said alkali metal hydroxide is sodium hydroxide.

14. The method of claim 11 wherein said water soluble hydroxy organic solvent is selected from the group consisting of diethylene glycol, ethylene glycol, and propylene glycol.

15. The method of claim 11 further comprising water washing said liquid free-base layer after said separating step.

16. The method of claim 11 wherein said layers are separated by decanting the water layer.

17. The method of claim 11 wherein said free-base and water layers are heated to a temperature of from about 60° C. to 85° C.

* * * * *